US009506326B2

(12) United States Patent
Hay et al.

(10) Patent No.: US 9,506,326 B2
(45) Date of Patent: Nov. 29, 2016

(54) ROTATIONALLY-INDEPENDENT WELLBORE RANGING

(71) Applicant: Halliburton Energy Services, Inc., Houston, TX (US)

(72) Inventors: Richard Thomas Hay, Spring, TX (US); Mac Upshall, Spring, TX (US); Christopher A. Golla, Houston, TX (US); Burkay Donderici, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/357,738

(22) PCT Filed: Jul. 11, 2013

(86) PCT No.: PCT/US2013/050088

§ 371 (c)(1),
(2) Date: May 12, 2014

(87) PCT Pub. No.: WO2015/005924

PCT Pub. Date: Jan. 15, 2015

(65) Prior Publication Data

US 2015/0083409 A1 Mar. 26, 2015

(51) Int. Cl.

| | |
|---|---|
| ***E21B 41/00*** | (2006.01) |
| ***E21B 17/10*** | (2006.01) |
| ***E21B 47/01*** | (2012.01) |
| ***E21B 47/022*** | (2012.01) |
| ***E21B 44/00*** | (2006.01) |

(52) U.S. Cl.

CPC ..... *E21B 41/0035* (2013.01); *E21B 17/1078* (2013.01); *E21B 44/005* (2013.01); *E21B 47/01* (2013.01); *E21B 47/02216* (2013.01)

(58) Field of Classification Search

None

See application file for complete search history.

(56) References Cited

U.S. PATENT DOCUMENTS

| | | | | |
|---|---|---|---|---|
| 4,072,200 | A * | 2/1978 | Morris et al. | 175/45 |
| 4,346,460 | A | 8/1982 | Schuster | |
| 5,168,942 | A * | 12/1992 | Wydrinski | 175/50 |
| 5,185,578 | A | 2/1993 | Stolarczykz | |
| 5,265,682 | A | 11/1993 | Russell et al. | |

(Continued)

FOREIGN PATENT DOCUMENTS

| | | |
|---|---|---|
| GB | 2066878 | 7/1981 |

OTHER PUBLICATIONS

Authorized officer Lee, Jong Kyung, International Search Report and Written Opinion in International Application No. PCT/US2013/050088, mailed Apr. 11, 2014, 16 pages.

(Continued)

*Primary Examiner* — Kenneth L Thompson
*Assistant Examiner* — Caroline Butcher
(74) *Attorney, Agent, or Firm* — Alan Bryson; Parker Justiss, P.C.

(57) ABSTRACT

A rotationally independent wellbore ranging system includes a housing which is attached to a rotary component positioned in a first wellbore and remains substantially stationary relative to the first wellbore when the rotary component rotates in the first wellbore. Multiple sensors affixed to the housing are operable to receive multiple ranging signals from a second wellbore while the rotary component rotates in the first wellbore, and provide the multiple ranging signals to a processor to determine a position of the first wellbore relative to the second wellbore.

26 Claims, 4 Drawing Sheets

(56) References Cited

U.S. PATENT DOCUMENTS

| | | | | |
|---|---|---|---|---|
| 5,458,208 | A | 10/1995 | Clarke | |
| 5,594,343 | A | 1/1997 | Clark et al. | |
| 5,923,170 | A | 7/1999 | Kuckes | |
| 6,075,462 | A | 6/2000 | Smith | |
| 6,173,793 | B1 | 1/2001 | Thompson et al. | |
| 6,534,986 | B2 | 3/2003 | Nichols | |
| 6,538,447 | B2 | 3/2003 | Bittar | |
| 6,961,663 | B2 | 11/2005 | Sinclair et al. | |
| 6,978,850 | B2 | 12/2005 | Sawyer | |
| 7,083,006 | B2 | 8/2006 | Kruspe et al. | |
| 7,183,771 | B2 | 2/2007 | Flanagan | |
| 7,306,058 | B2 | 12/2007 | Cargill et al. | |
| 7,568,532 | B2 | 8/2009 | Kuckes et al. | |
| 7,812,610 | B2 | 10/2010 | Clark et al. | |
| 7,898,494 | B2 | 3/2011 | Brune et al. | |
| 8,151,907 | B2 | 4/2012 | MacDonald | |
| 2003/0213620 | A1 | 11/2003 | Krueger | |
| 2004/0020691 | A1 | 2/2004 | Krueger | |
| 2007/0144782 | A1 | 6/2007 | Krueger et al. | |
| 2008/0041626 | A1 | 2/2008 | Clark | |
| 2008/0294344 | A1* | 11/2008 | Sugiura | E21B 47/024 702/6 |
| 2009/0114039 | A1* | 5/2009 | Schultze | A61B 5/06 73/861.77 |
| 2009/0164127 | A1 | 6/2009 | Clark | |
| 2009/0178850 | A1* | 7/2009 | Waters | E21B 47/02216 175/45 |
| 2009/0194333 | A1 | 8/2009 | MacDonald | |
| 2009/0201026 | A1 | 8/2009 | McElhinney | |
| 2010/0044108 | A1 | 2/2010 | Bespalov et al. | |
| 2010/0277177 | A1 | 11/2010 | Alumbaugh et al. | |
| 2010/0308832 | A1 | 12/2010 | Clark et al. | |
| 2011/0006773 | A1 | 1/2011 | Bittar | |
| 2011/0018542 | A1 | 1/2011 | Clark et al. | |
| 2011/0121835 | A1 | 5/2011 | Brune et al. | |
| 2012/0061143 | A1* | 3/2012 | Hay | E21B 47/122 175/57 |
| 2012/0194195 | A1* | 8/2012 | Wisler et al. | 324/346 |

OTHER PUBLICATIONS

Authorized officer Lee, Jong Kyung, International Search Report and Written Opinion in International Application No. PCT/US2013/030291, mailed Nov. 21, 2013, 20 pages.

Australian Government IP Australia, Australian Patent Application No. 2013393828, Patent Examination Report No. 1, Mar. 14, 2016, 3 pages.

* cited by examiner

ROTATIONALLY-INDEPENDENT WELLBORE RANGING

CLAIM OF PRIORITY

This application is a U.S. National Stage of PCT/US2013/050088 filed on Jul. 11, 2013.

TECHNICAL FIELD

The present disclosure relates to relative distance and azimuth measurements between wellbores formed in subsurface formation(s).

BACKGROUND

Wellbores formed in subterranean hydrocarbon reservoirs enable recovery of a portion of the hydrocarbons using production techniques. The hydrocarbons can adhere to the reservoirs, for example, due to a combination of capillary forces, adhesive forces, cohesive forces, and hydraulic forces. Steam-assisted gravity drainage (SAGD) is an example of an enhanced hydrocarbon recovery technique in which heated treatment fluids (for example, steam) can be applied to the formation to facilitate and enhance recovery of the hydrocarbons that are adhered to the formation. In an implementation of the SAGD technique, an injection wellbore can be formed adjacent to a production wellbore, and the heated treatment fluids can be injected through the injection wellbore into the formation surrounding the production wellbore. The heated fluids can decrease an adherence of the hydrocarbons to the formation, thereby releasing the hydrocarbons into the production wellbore.

While forming (for example, drilling) the injection wellbore, knowledge of a location of the production wellbore relative to the injection wellbore can be important. Traditional surveying techniques provide an estimate location for individual well bores. However, due to a large size of the cone of uncertainty associated with such measurement, a more accurate measurement is required in SAGD or similar applications. Ranging is an example of a method to control a position of a wellbore being drilled relative to an existing wellbore. In ranging, an electromagnetic field from the existing wellbore provides electromagnetic signals received by sensors in the wellbore being drilled. Several conditions, for example, wellbore drilling conditions, can adversely affect an ability of the electromagnetic sensors to sense the electromagnetic signals, and, consequently, affect ranging in the wellbores.

DESCRIPTION OF DRAWINGS

Like reference symbols in the various drawings indicate like elements.

DETAILED DESCRIPTION

The present disclosure relates to relative distance and azimuth measurements ("ranging") between wellbores formed in subsurface formation(s). More particularly, this disclosure relates to a rotationally independent wellbore ranging system and associated methods. In the example of an SAGD application, precise ranging of the steam injection wellbore can be important. If the steam injection wellbore is too far from the production wellbore, the steam injection may not result in significant increased recovery. In another example of drilling a relief wellbore, if the relief wellbore intersects the production wellbore, a potentially hazardous condition such as a blowout can result from the pressure difference between the wells. Yet another example is a well intersection application where a well is being drilled to intersect with and plug a blow out well. A ranging process can be used to determine the distance and precise location between a wellbore being drilled and an existing wellbore, and steer the well path based on the requirements of the application.

In some situations, the ranging process (or ranging) is implemented by disposing ranging sensors (described below) in a rotary component (e.g., a drill string) of the wellbore being formed, e.g., the injector wellbore. If the ranging sensors move when ranging measurements are made, movement of magnetic sensors can induce changes in the flux through the coil due to relatively low frequency of operation and earth's magnetic field inducing false signals at the receiving coils. For this reason, ranging sensors are often stationary when ranging measurements are taken. Drilling operations using the drill string may need to be ceased so that the ranging sensors are stationary to make accurate ranging measurements. Periodically ceasing and restarting the SAGD wellbore drilling process to determine the wellbore relative positions can result in non-productive time (i.e., lost drilling time).

This disclosure describes techniques to dispose the ranging sensors on a stationary platform relative to a rotary component on which the ranging sensors are disposed. The stationary platform can allow for relatively low frequency ranging measurements to be accomplished while the rotary component (e.g., the drill string) continues to rotate during drilling operations. Because drilling operations can be continued while range sensing operations are being performed, a speed with which a relief well intersects a target well can be increased, e.g., in blow-out situations. Further, a speed at which SAGD wellbores are drilled by implementing the techniques described here can increase because the operations to drill the SAGD wellbores need not be stopped, e.g., as frequently as the operations would need to be stopped absent the stationary platform. In the well avoidance application, speed at which the wells are being drilled can be increased, producing similar decrease in the non-productive time.

Figure 1:
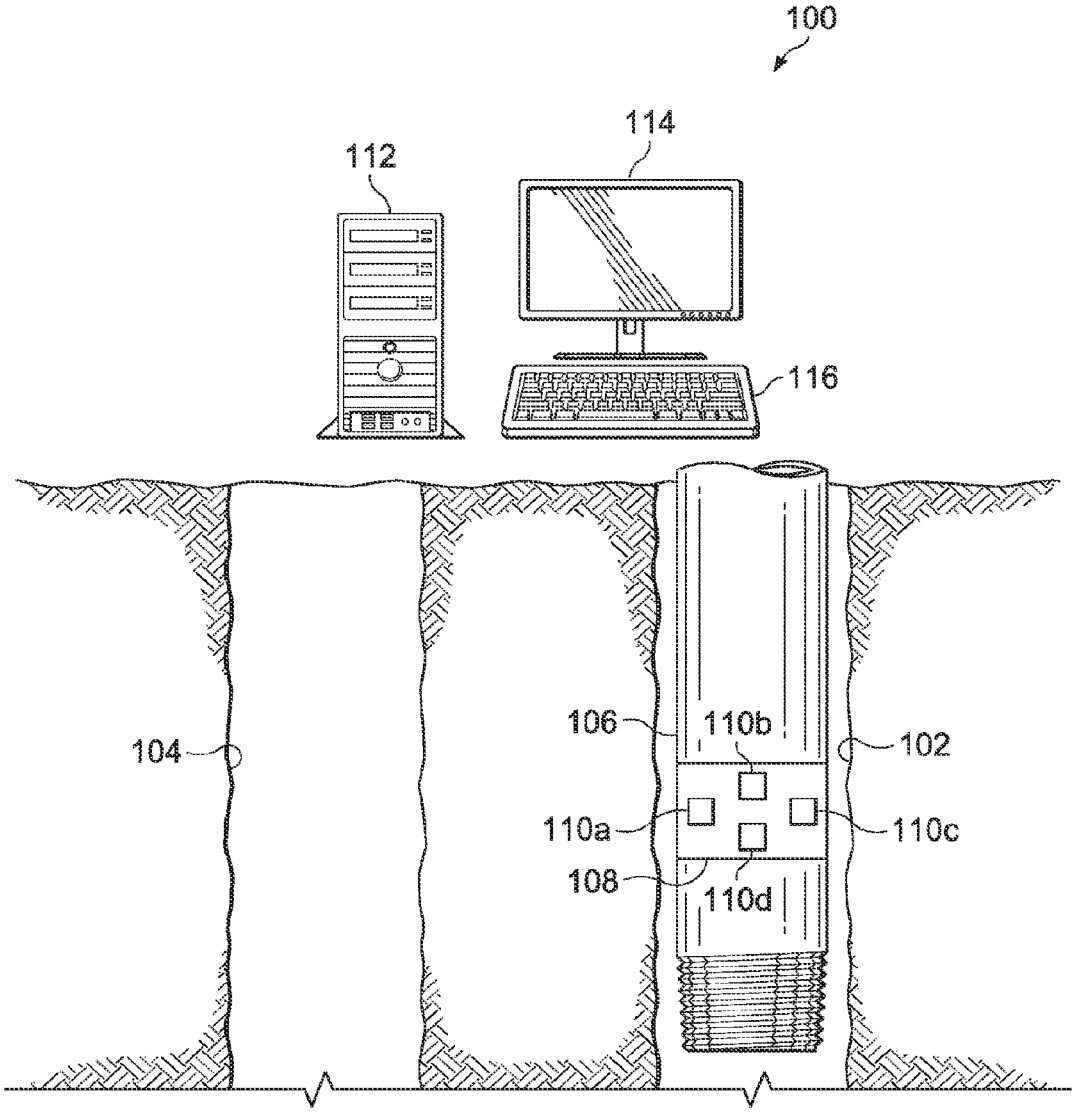
FIG. 1 illustrates an example wellbore system that includes wellbores for ranging.

FIG. 1 illustrates an example wellbore system 100 that includes wellbores for ranging. In some implementations, a housing 108 (e.g., a cylindrical housing) can be attached to a rotary component 106 (e.g., a cylindrical drill string) disposed in a first wellbore 102 (e.g., a SAGD wellbore). The housing 108 can be hollow and can be disposed on an outer circumference of the rotary component 106. Alternatively, or in addition, the housing 108 can be a cylindrical length of a string connected serially to a length of the rotary component 106. As described below, the housing 108 remains substantially stationary relative to the rotary component 106 when the rotary component 106 rotates in the first wellbore 102. Multiple sensors 110 (e.g., a first sensor 110*a*, a second sensor 110*b*, a third sensor 110*c*, a fourth sensor 110*d*, or more or fewer sensors) can be affixed to the housing 108, e.g., in a region between an inner surface of the housing 108 and an outer surface of the rotary component 106.

In some implementations, the housing 108 can be disposed to rotate about a load bearing part of the rotary component 106. The housing 108 can be made from a non-magnetic material that does not interact with magnetic fields allowing accurate measurement of the magnetic fields. For example, the housing 108 can be made from materials such as aluminum or copper. One or more insulating gaps can be placed, e.g., at the top, bottom or in the middle of the housing to keep currents from flowing down the rotary component 106 and generating spurious magnetic fields and signals. Insulating gaps can be a part of the housing 108 or of the rotary component 106. The housing 108 can also be fitted with one or more contacting devices (e.g., contacting device 201) for contacting the wall of the first wellbore 102 and holding the housing 108 and the multiple sensors 110 stationary relative to the wall of the first wellbore 102. Example contacting devices can include pads, paddles, expandable bladders, extendable arms, or other suitable contacting devices.

The multiple sensors 110 are operable to perform ranging operations (described below) to determine a position of the first wellbore 102 relative to a second wellbore 104 (e.g., a production wellbore or any target wellbore). The multiple sensors 110 can receive multiple ranging signals from the second wellbore 104 while the rotary component 106 rotates in the first wellbore 102. In other words, the rotary component 106 to which the housing 108 is affixed need not be stopped for the multiple sensors 110 to perform ranging operations. The multiple sensors 110 can provide the multiple signals to a processor (e.g., a computer system 112 disposed at the surface).

The computer system 112 can include a computer-readable medium to store the multiple signals and a data processing apparatus to process the multiple ranging signals to determine a position of the first wellbore 102 relative to the second wellbore 104. In response to an input received, e.g., through an input device 116, requesting the determined position, the computer system 112 can present the position, e.g., on a display device 114 connected to the computer system 112. The computer system 112 can be any type of computer, e.g., a desktop computer, a laptop computer, a tablet computer, a smartphone, a personal digital assistant (PDA), or any other suitable computer. The computer system 112 can be connected to the multiple sensors 110 through any network, e.g., a wired or wireless network, or a telemetry system, or combinations of them.

Figure 2:
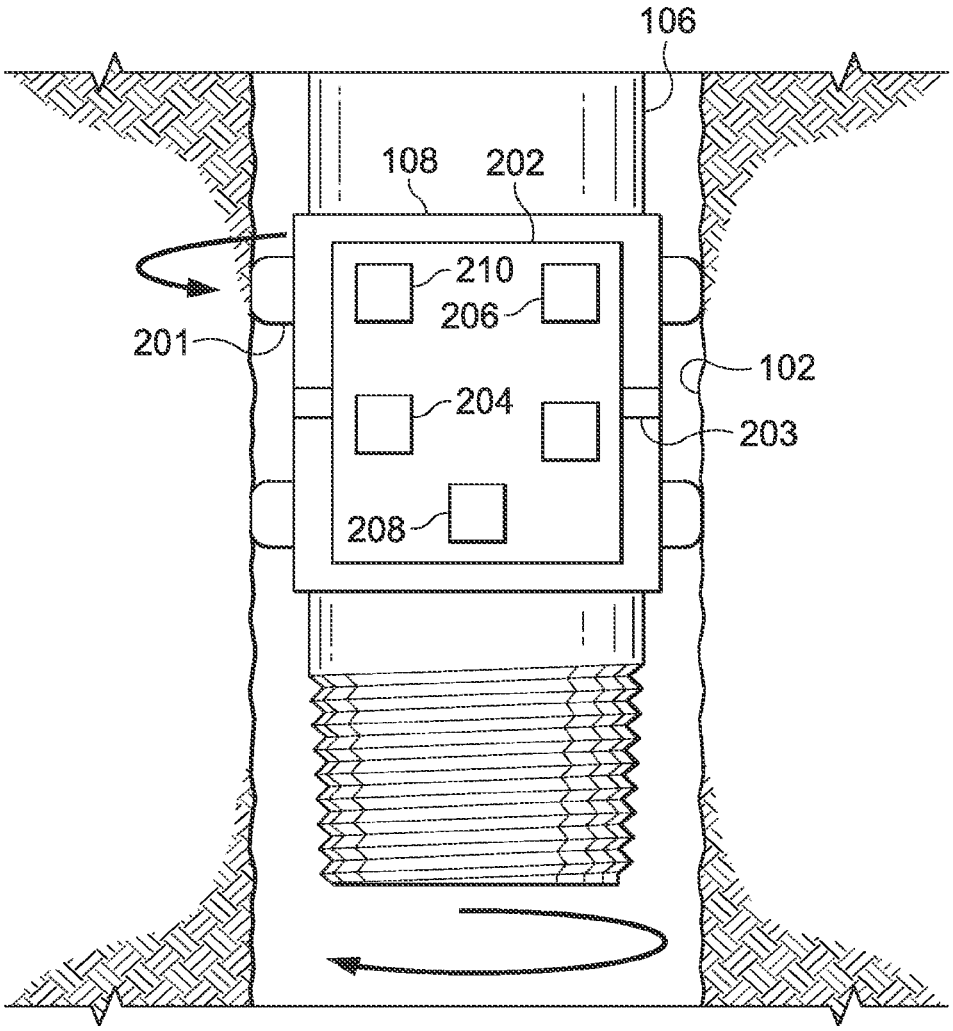
FIG. 2 illustrates the example housing of FIG. 1 affixed to the rotary component of FIG. 1 using bearings.
Figure 3:
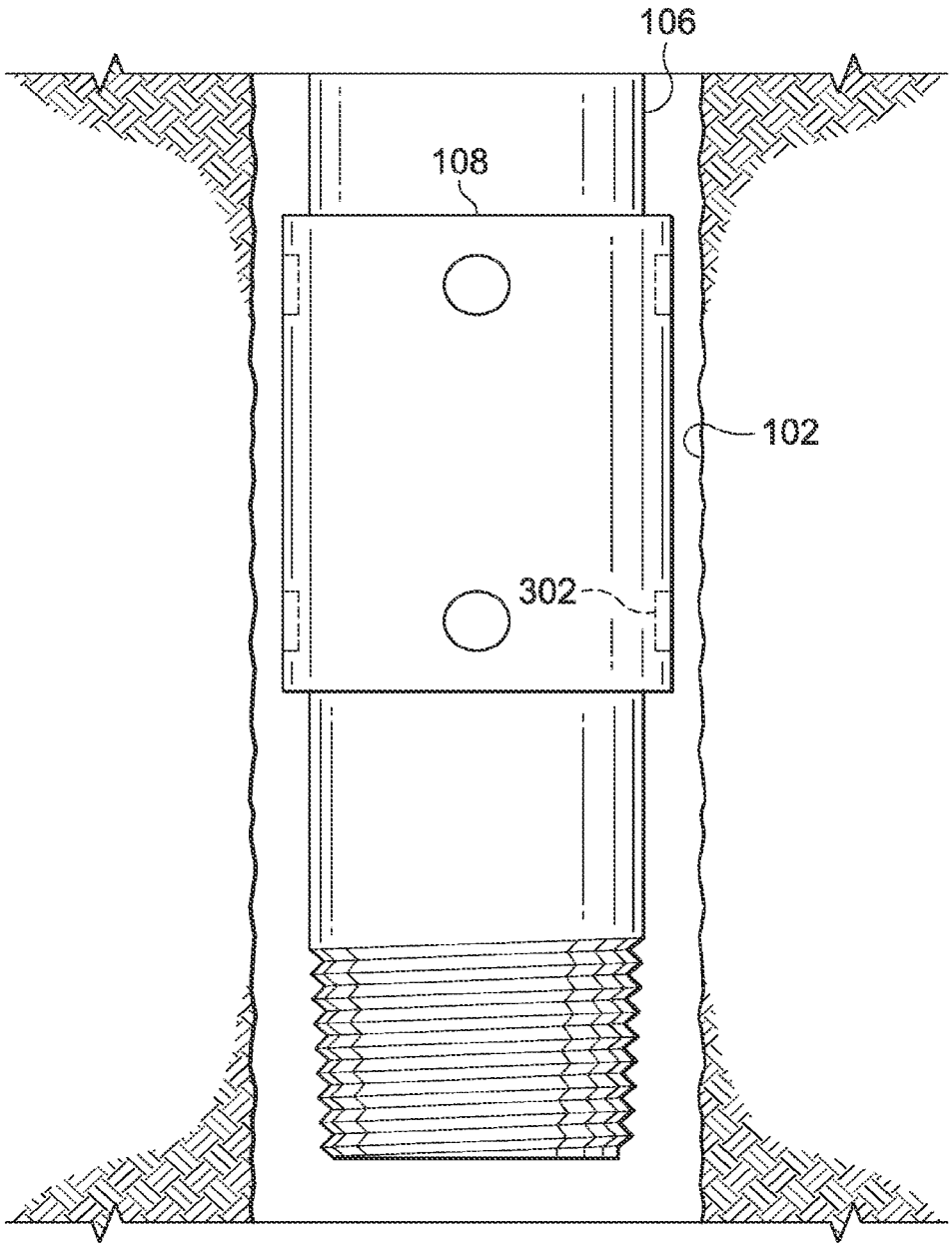
FIG. 3 illustrates the example housing of FIG. 1 affixed to the rotary component of FIG. 1 using a counter-rotation motor.

FIGS. 2 and 3 illustrate two different techniques to affix the housing 108 to the rotary component 108. In some implementations, a counter-rotation motor 202 can be affixed to the housing 108 (FIG. 2). A speed of rotation of the counter-rotation motor 202 is substantially equal and opposite to a speed of rotation of the rotary component 106. The speed of rotation of the counter-rotation motor maintains the housing 108 substantially stationary with respect to the wall of the first wellbore 102. In some implementations, the counter-rotation motor 202 is electrically insulated to mitigate or minimize interference.

The counter-rotation motor 202 can be powered using a battery or a generator 206 disposed either at the surface or in the housing 108. In implementations in which the rotary component 106 is a drill string, the generator 206 can be configured to be powered by flow of drilling fluid through the drill string. Doing so can allow placing the housing 108 separately along the rotary component 106 from other powered mechanisms.

In some implementations, the counter-rotation motor 202 can be operated to maintain the housing 108 substantially stationary with respect to the wall of the first wellbore 102 whenever the rotary component 106 rotates. Alternatively, the counter-rotation motor 202 can be operated to maintain the housing 108 substantially stationary with respect to the wall of the first wellbore 102 only at those times that the multiple sensors 110 are operated to receive ranging signals from the second wellbore 104. At other times, the counter-rotation motor 202 may not be operated resulting in the housing 108 rotating with the rotary component 106 resulting in a decrease in battery or generator power consumption.

The counter-rotation motor 202 is configured to receive control signals to control the rotation and the speed of rotation of the counter-rotation motor 202. For example, the housing 108 can include a control system 204 connected to the counter-rotation motor 202 and the multiple sensors 110. The control system 204 can be powered by the same battery or generator 206 that powers the counter-rotation motor 202. The control system 204 is configured to control the counter-rotation motor 202 to rotate in an opposite direction to the rotary component 106 when controlling the multiple sensors 110 to receive and provide the multiple ranging signals. For example, the control system 204 can be affixed to (e.g., incorporated within) the housing 108 and implemented as processor circuitry or computer program instructions implemented in firmware, hardware, software, or combinations of them. Alternatively, or in addition, the control system 204 can be disposed at the surface, e.g., as a unit of or separate from the computer system 112, to provide control signals from the surface to the housing 108, the counter-rotation motor 202, the multiple signals 110, or combinations of them.

In some implementations, the control system 204 can include or be connected to movement or orientation sensors 208 (e.g., accelerometers, inclinometers, magnetometers, or combinations of them) that continuously measure position and orientation of the housing 108 and re-adjust the position and orientation based on feedback. Measurement devices 210 for the feedback control purposes can be placed either in the housing 108 or in the rotary component 106. Placing the measurement devices in the housing 108 can allow for more sensitive control due to the absence of a dynamic common mode. In addition to the rotational correction, devices to implement tilt correction can also be disposed to compensate for (e.g., correct) any tilting effects that may be coupled with rotation, e.g., due to a curved mandrel axis in the rotary component 106. The movement or orientation sensors can determine reference orientations of the tool based on Earth's coordinate system or based on Earth's magnetic field orientation or combinations of them. At very low frequencies (e.g., less than 10 Hz), the rotation and tilt sensors can be implemented to compensate for the changes in earth's magnetic field. In addition, devices to implement eccentricity correction to compensate for any eccentricity effects may be coupled with rotation, e.g., due to a curved mandrel axis in the rotary component 106. The correction can be based on the measurements provided by the movement sensors. All of the above corrections can be applied through a feedback circuit that is set to minimize variations in the movement/orientation signals.

As alternatives to or in addition to being affixed to a counter-rotation motor 202, the housing 108 can also be fitted with one or more contacting devices 202 for contacting the wall of the first wellbore 102, and holding the housing 108 and the multiple sensors 110 stationary relative to the wall of the first wellbore 102 while the rotary component 106 continues to rotate (FIG. 3), as described above. In conjunction with the contacting device 302, a bearing assembly can be positioned between the housing 108 and the rotary component 106. For example, an inner surface of the housing 108 can be affixed to an outer surface of the rotary component 106 (e.g., drill string) using a dampening device 203 (e.g., one or more bearings) such that the rotational movement of the drill string is not transferred to the housing 108 when the rotary component 108 rotates, e.g., to drill the SAGD wellbore (FIG. 2). Because the rotational movement of the rotary component 108 is not transferred to the housing 108, the multiple sensors 110 affixed to the housing 108 can sense the multiple ranging signals received from the second wellbore 104 without requiring that the rotary component 108 cease operation.

The dampening device 203 can be a bearing, as described above, or any material that can provide a non-rigid contact between the housing 108 and the rotary component 106. The material can be suitable to dampen axial, radial or rotational vibrations which can adversely affect ranging measurements if the housing 108 rotates during ranging operations. The non-rigid contact material can be spring-based contact material, a compressible material, a flexible material, or combinations of them. For example, the non-rigid contact material can be rubber or other similar polymer.

Because the housing 108 is not subjected to the rotational movement of the rotary component 106, the outer diameter of the housing 108 can be larger than that of the outer diameter of the rotary component 106, e.g., to more closely match the inner diameter of the first wellbore 102 (FIG. 3) than the rotary component 106. Increasing the diameter of the housing 108 to more closely match the diameter of the first wellbore 102 can increase the gradient measurement capability (described below) of the multiple sensors 110.

In some implementations, the housing 108 can be further stabilized within the first wellbore 102 by establishing and increasing the contact with the wall of the first wellbore 102. To do so, the housing 108 can be expanded to apply pressure on the wall of the first wellbore 102. In such situations, the housing 1089 can have non-rigid contact axially such that the housing 108 can be stationary even when a tool (e.g., a drill bit attached to the rotary component 106) moves up or down in the first wellbore 102. When the relative axial movement of the housing 108 becomes a limitation with respect to the drill string, the housing 108 can be deflated and slid down on the rotary component 106 and the afore-described operations can be repeated. Such movement can be produced by utilizing gravity, electrical or mechanical motor or strong electromagnets.

Figure 4A:
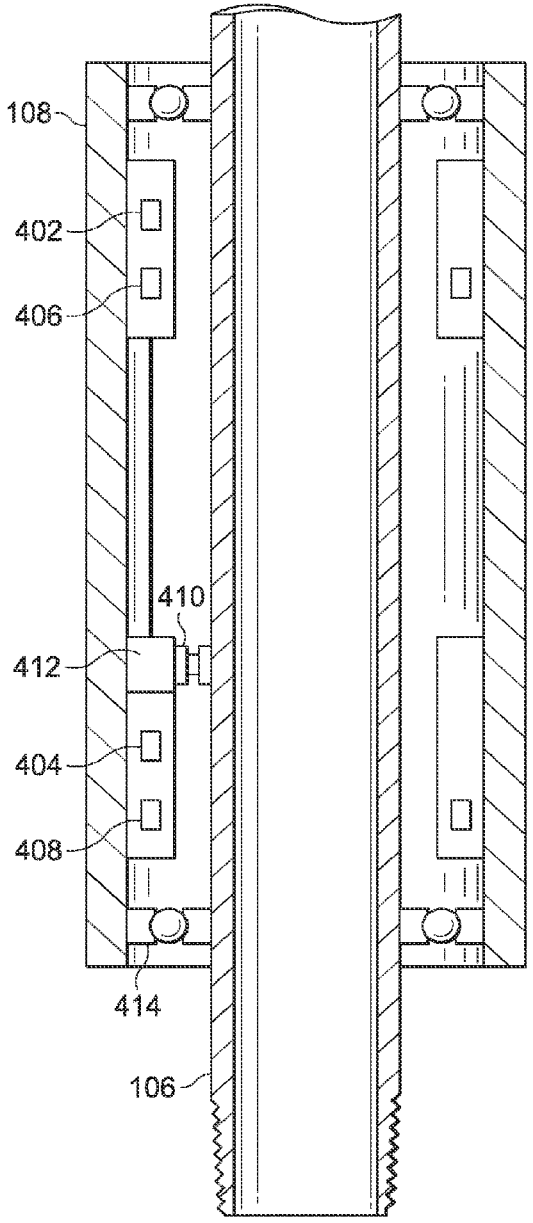
FIGS. 4A and 4B illustrate example sensors 110 disposed within the example housing 108 of FIG. 1.
Figure 4B:
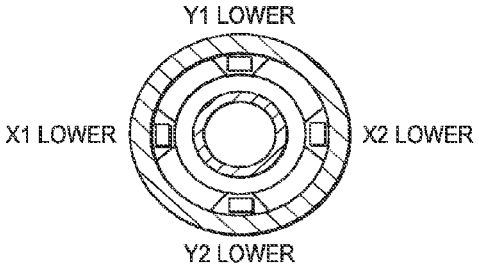

FIGS. 4A and 4B illustrate example sensors 110 disposed within the example housing 108 of FIG. 1. Here the sensors are magnetic field measurement devices such as magnetometers or induction coils. Each sensor is sensitive to magnetic fields in different directions. The magnetic field sensor that is sensitive to the magnetic field in the axial direction is denoted here as Z sensor. X sensor and Y sensor are used to denote sensors that are sensitive to fields in the normal plane, where the azimuth is referenced to a fixed and arbitrary azimuthal direction on the tool. The sensors 110 can include a first Z sensor 402 and a second Z sensor 404 disposed near an upper end and a lower end of the housing 108, respectively. A first X-Y sensor 406 and a second X-Y sensor 408 can also be disposed near the upper end and the lower end of the housing 108, respectively, e.g., near the first Z sensor 402 and the second Z sensor 404, respectively. A slip ring 410 can be disposed within the housing 108 adjacent the control system 412. Communication to the rest of the BHA can be implemented using the slip ring or some other form of inductive coupling such as a toroid or a solenoid. The sensors 110, the control system 412 and other components (e.g., the slip ring 410) disposed between the housing 108 and the rotary component 106 can be connected by a power/communications bus 414 that provides power to each of the components.

In some implementations, accelerometers (not shown) can be disposed proximate, e.g., generally on the same axis, as the sensors 110. To maximize the gradient measurement, the sensors 110 can be pushed out as far to the edges of the housing 108 as possible. The Z-axis sensor (e.g., the first Z sensor 402 or the second Z sensor 404) can be displaced over a large distance in the housing 108.

The arrangement of sensors 110 and other components in FIGS. 4A and 4B represent one configuration in which the sensors 110 can be arranged; other configurations and arrangements are possible. For example, in FIGS. 4A and 4B, the sensors are illustrated as being integral to the housing 108. Alternatively, or in addition, the sensors 110 can be disposed in sonde like tubulars or other package arrangements, and positioned on or inside the housing 108. For example, one or more sensors 110 can be disposed in outserts mounted in a pocket in the housing or in an insert inside the housing 108. In some implementations, a second set of X-Y sensors can be implemented to measure the cross-axis gradient over the Z-axis length using a second upper X-Y sensor arrangement.

The multiple ranging sensors 110 can be multi-axial magnetic field sensors that measure an intensity and a phase of the magnetic field in two or more orientations. The sensors 110 can be placed with a separation in a gradient orientation to measure a magnetic field gradient. Magnetic field gradient can be used to measure distance to an elongated target such as the casing of the second wellbore 104. It is known that gradient measurement that is made along a certain direction is only sensitive to targets in certain directions. Rotation angle of the housing 108 can be actively stabilized at an angle that optimizes the gradient signal from the second wellbore 104. The techniques described here can be implemented as multiple housings, each of which is independently stabilized as described above with reference to the housing 104. Multiple sensors can be placed in each housing and rotation of each housing can be adjusted to optimize the measurement made from each housing.

Figure 5:
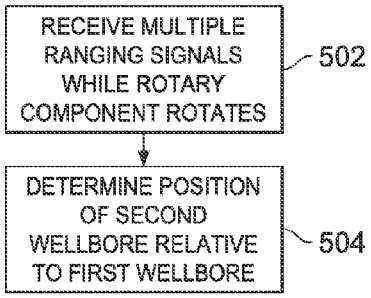
FIG. 5 is a flowchart of an example process for ranging while the rotary component continues to rotate.

FIG. 5 is a flowchart of an example process 500 for ranging while the rotary component continues to rotate. In some implementations, the process 500 can be implemented by the multiple sensors 110 in cooperation with the computer system 112. At 502, multiple ranging signals are received at a rotary component in a first wellbore from a second wellbore while the rotary component is rotating in the first wellbore. At 504, a position of the second wellbore relative to the first wellbore is determined based on and in response to receiving the multiple ranging signals.

In some implementations, input can be received, e.g., from a user of the computer system 112, to determine the position of the second wellbore relative to the first wellbore. Until the input is received, the housing 108 can rotate with the rotary component 106. In response to receiving the input, a rotation of the housing 108 can be substantially stopped relative to the rotary component 106 while the rotary component 106 continues to rotate. The multiple ranging signals can be received.

The received ranging signals can be processed, e.g., by the computer system 112, based on a magnetic field detected by the sensors. The magnetic field can be generated in the second wellbore 104 by transmitting a current through a pipe (e.g., the casing) in the second wellbore 104. The pipe current and the magnetic field are related as shown below.

$$\overline{H} = \frac{I}{2\pi r}\hat{\phi} \tag{1}$$

H is the magnetic field vector, I is the current on the pipe, r is the shortest distance between the receivers and the pipe and ϕ is a vector that is perpendicular to both z axis of the receiver and the shortest vector that connects the pipe to the receivers. The equation above is a simple relationship which assumes constant pipe current along the pipe. However, the techniques described here can be extended to any current distribution by using the appropriate model. Both distance and direction can be calculated by using the following relationship.

$$r = \frac{I}{2\pi|\overline{H}|} \tag{2}$$

$$\Phi = \text{angle}(\hat{x}\cdot\overline{H}, \hat{y}\cdot\overline{H}) + 90 \tag{3}$$

In the equations above, "·" is the vector inner-product operation. It has been observed by experience that equation (3) is a reliable way to measure the relative direction of the target pipe with respect to receiver coordinates and it can be used as long as signal received from the pipe is substantially large compared to the measurement errors. However equation (2) cannot be reliably used to calculate distance since a direct or accurate measurement of I does not exist. It has also been observed that any analytical calculation of I can be off due to unknown target pipe characteristics. Furthermore any in-situ calibration of I does not produce a system reliable enough to be used in the SAGD application due to variations in pipe current due to changing formation resistivity and skin depth at different sections of a well. Consequently, a ranging process that implements equations (2) and (3) may not be suitable for ranging in SAGD applications.

Specifically, relevant characteristics of the target pipe such as conductivity and magnetic permeability are known to show large variations between different casing pieces, and also to change in time due to effects such as mechanical stress, temperature and corrosion. Since distribution of current on the target pipe depends on the skin depth and hence resistance per pipe length, making an accurate analytical estimation about the current excited on the pipe due to the source can be difficult. In addition, variations along different pipe sections can also make it very difficult to calibrate pipe current in one section of the pipe based on another. It has been observed that distance from absolute measurement magnitude can detect presence of the target from farther away albeit with a very large cone of uncertainty. Gradient measurement, on the other hand, can detect the target at shorter distances with a relatively smaller cone of uncertainty. The requirement in the SAGD application falls inside the gradient measurement capability range and as a result it has a clear advantage when compared to a system based on absolute measurement.

A solution is to utilize magnetic field gradient measurement, where spatial change in the magnetic field is measured in a direction that has a substantial component in the radial (r-axis) direction as below.

$$\frac{\partial\overline{H}}{\partial r} = -\frac{I}{2\pi r}\hat{\phi} \tag{4}$$

In the equation above, "∂" is the partial derivative. With this gradient measurement available in addition to an absolute measurement, it is possible to calculate the distance as follows.

$$r = \frac{|\overline{H}|}{\left|\frac{\partial\overline{H}}{\partial r}\right|} \tag{5}$$

Equation (5) does not require knowledge of the pipe current I, if both absolute and gradient measurements are available. The direction measurement can still be made as shown in equation (3).

In some situations, it may not be feasible to measure all components of the magnetic field which are required for making use of all of the above equations. For a single component of the magnetic field that is oriented in direction u, the magnetic field can be written as shown below.

$$\overline{H}\cdot\hat{u} = \frac{I}{2\pi r}(\hat{u}\cdot\hat{\phi}) \tag{6}$$

In the equation above, the hat sign indicates unit vectors and bar indicates vectors. Similarly, the u-component magnetic field gradient along v direction can be written as shown below.

$$\begin{aligned}\frac{\partial\overline{H}\cdot\hat{u}}{\partial v} &= \frac{\partial\frac{I}{2\pi r}\hat{\phi}\cdot\hat{u}}{\partial v}\\ &= \frac{I}{2\pi}\frac{\partial\frac{1}{r}\hat{\phi}\cdot\hat{u}}{\partial v}\\ &= \frac{I}{2\pi}\frac{\partial\frac{1}{r}\hat{\phi}}{\partial v}\cdot\hat{u}\\ &= \frac{I}{2\pi}\left(\frac{\partial\frac{1}{r}}{\partial v}\hat{\phi} + \frac{1}{r}\frac{\partial\hat{\phi}}{\partial v}\right)\cdot\hat{u}\\ &= \frac{I}{2\pi}\left(-(\hat{v}\cdot\hat{r})\frac{1}{r^2}\hat{\phi} - \frac{1}{r}(\hat{v}\cdot\hat{\phi})\frac{\hat{r}}{r}\right)\cdot\hat{u}\\ &= -\frac{I}{2\pi r^2}\left((\hat{v}\cdot\hat{\phi})(\hat{u}\cdot\hat{r}) + (\hat{v}\cdot\hat{r})(\hat{u}\cdot\hat{\phi})\right)\end{aligned} \tag{7}$$

With these absolute and gradient measurements available, distance to target can be written as shown below.

$$\frac{\overline{H}\cdot\hat{u}}{\frac{\partial\overline{H}\cdot\hat{u}}{\partial v}} = -r\frac{(\hat{u}\cdot\hat{\phi})}{\left((\hat{v}\cdot\hat{\phi})(\hat{u}\cdot\hat{r}) + (\hat{v}\cdot\hat{r})(\hat{u}\cdot\hat{\phi})\right)} \tag{8}$$

In the equation above, $$\hat{r}=\hat{x}\cos(\Phi)+\hat{y}\sin(\Phi)$$

$$\hat{\phi}=\hat{x}\sin(\Phi)+\hat{y}\cos(\Phi) \quad (9)$$

In an example case, where $H_y$ component is measured along x, equations (7-9) can be combined as shown below.

$$\frac{H_y}{\frac{\partial H_y}{\partial x}} = r\frac{\cos(\Phi)}{(\sin(\Phi)^2-\cos(\Phi)^2)} \quad (10)$$

Finally distance can be written as shown below.

$$r = \frac{H_y}{\frac{\partial H_y}{\partial x}}\frac{(\sin(\Phi)^2-\cos(\Phi)^2)}{\cos(\Phi)} \quad (11)$$

The gradient field in equation (11) is realized in practice by utilizing finite difference of two magnetic field dipole measurements as shown below.

$$r = \frac{H_y}{\frac{H_y\left(x+\frac{\Delta x}{2},\, y\right)-H_y\left(x-\frac{\Delta x}{2},\, y\right)}{\Delta x}} \quad (12)$$

Gradient measurement described above can be used commercially in applications other than SAGD. However, a drawback reduces its reliability and makes it unsuitable for SAGD application. It can be seen from equation (10) that gradient measurement with a single component becomes unstable due to singularity of the denominator every 90° starting from 45°. As a result, gradient measurement with a single component is only sensitive to angles 90°×k, where k is an integer. This conclusion remains the same for the configurations where 4 dipoles are used to calculate the magnetic fields. It should be noted here that 3 dipoles may be used for achieving the gradient measurement described above (2 for gradient+1 for absolute). Other configurations include 3-, 4- and 8-dipole gradient measurement configurations.

3- and 4-dipole devices can make good measurement of gradient field in directions that are in the vicinity of 0°, 90°, 180° and 270°. One technique to expand the direction is to use dipoles and gradient measurements in more directions. For example, 4 dipoles can be arranged to cover 0°, 90°, 180° and 270° while 4 additional dipoles can cover 45°, 135°, 225° and 315°. Same or similar coverage can be achieved with a total of 6 dipoles without significantly impacting accuracy. The additional information provided by the extra dipoles can be used for different purposes such as quality control and having engineering advantages of a symmetric sensor array.

Receiver magnetic dipoles can be realized with magnetometers, atomic magnetometers, flux-gate magnetometers, solenoids or coils. Gradient measurement can also be conducted by electrically connecting two magnetic dipoles in different orientations and making a single measurement, as an alternative to or in addition to subtracting values of two separate magnetic field measurements.

An alternative technique, which is used in well intersection, is to use multiple direction measurements at different angles to the target, as shown in upper side. This requires the well to be placed in a spiral or S-shape which cannot be used in the SAGD application. Furthermore, this approach averages information over long distances and reduces the geosteering response time. In such a gradient ranging approach, the well can be placed parallel to the target well and it can have the ideal linear path. Furthermore since independent information can be available at each point, geosteering can respond to deviations in distances more quickly. To achieve best steering performance, receivers can be placed as close as possible to the bit, preferably next to it. In the SAGD application, drill string is substantially parallel to the target pipe, so placement of the receivers is less important in terms of steering performance. It is also possible to place the receivers elsewhere on the drill string, such as in the bit.

Rendering the housing 108 substantially stationary with respect to the wall of the first wellbore 102 does not require that the housing 108 be absolutely still relative to the housing 106. A quantity of rotation that is slow enough to not interfere with the ranging signals measured by the multiple sensors 110 can be acceptable. As described above, the ranging signals can be measured at a sampling frequency of between 0.1 Hz and 100 Hz. In some implementations, the housing 108 can be incorporated into the bottom hole assembly (BHA). In addition to ranging, the housing 108 can be implemented for other purposes in which it is beneficial to continue rotation of the rotary component 106.

A number of implementations have been described. Nevertheless, it will be understood that various modifications may be made without departing from the spirit and scope of the disclosure.

What is claimed is:

1. A system for ranging in wellbores, the system comprising:

a housing attached to a rotary component disposed in a first wellbore, wherein the housing is configured to rotate with or remain substantially stationary relative to the first wellbore when the rotary component rotates in the first wellbore; and a plurality of sensors affixed to the housing, wherein the plurality of sensors are positioned with a radial separation to measure a magnetic field gradient used to determine the position of the first wellbore relative to the second wellbore, wherein the plurality of sensors are positioned at outermost edges of the housing to maximize the gradient measurement, the plurality of sensors operable to:

receive a plurality of ranging signals from a second wellbore while the rotary component rotates in the first wellbore, each sensor configured to receive at least a portion of the plurality of ranging signals based on a magnetic field generated in the second wellbore by transmitting current through a casing of the second wellbore, and provide the plurality of ranging signals to a processor to determine a position of the first wellbore relative to the second wellbore, wherein the housing rotates relative to the first wellbore until input to receive the plurality of ranging signals from the second wellbore is received, wherein the housing substantially ceases to rotate relative to the first wellbore in response to receiving the input to receive the plurality of ranging signals, and wherein the housing rotates relative to the first wellbore after the plurality of ranging signals are provided to the processor.

2. The system of claim 1, wherein the housing includes a contacting device configured to contact a portion of a wall of the first wellbore and maintain the housing substantially stationary with respect to the wall of the first wellbore.

3. The system of claim 2, further comprising a dampening device comprising at least one of the members of a group consisting of at least one bearing, a spring-based contact material, a compressible material, and a flexible material.

4. The system of claim 1, further comprising a counter-rotation motor affixed to the housing, a speed of rotation of the counter-rotation motor is substantially equal and opposite to a speed of rotation of the rotary component, the speed of rotation maintaining the housing substantially stationary with respect to the first wellbore.

5. The system of claim 4, wherein the counter-rotation motor is configured to receive control signals to control the rotation and the speed of rotation of the counter-rotation motor.

6. The system of claim 5, wherein the counter-rotation motor is electrically insulated.

7. The system of claim 4, further comprising a control system connected to the counter-rotation motor and the plurality of sensors, the control system configured to automatically control the counter-rotation motor to rotate in an opposite direction to the rotary component in response to controlling the plurality of sensors to receive and provide the plurality of ranging signals.

8. The system of claim 7, further comprising a battery or a generator to power the counter-rotation motor or the control system or both.

9. The system of claim 8, wherein the rotary component comprises a drill string, and wherein the generator is configured to be powered by flow of drilling fluid through the drill string.

10. The system of claim 1, wherein the housing comprises at least one of an accelerometer, an inclinometer, or a magnetometer to continuously measure position and orientation of the housing, each configured to receive respective control signals to control an orientation of the housing.

11. The system of claim 10, further comprising feedback measurement devices to measure and provide an orientation of the housing, wherein the feedback measurement devices are disposed on either the housing or the rotary component.

12. The system of claim 1, wherein the outer diameter of the housing is substantially equal to an inner diameter of the wellbore.

13. The system of claim 12, wherein the outer diameter of the housing is adapted to be decreased to be less than the inner diameter of the wellbore, the system further comprising at least one of an electrical motor, a mechanical motor or electromagnets to move the housing within the wellbore after the outer diameter of the housing has been decreased to be less than the inner diameter of the wellbore.

14. The system of claim 1, wherein the housing is included in a bottom hole assembly.

15. The system of claim 1, wherein each sensor is a multi-axial magnetic field sensor that measures an intensity and a phase in two or more orientations.

16. The system of claim 1, wherein the plurality of sensors are integral to the housing or affixed to an inside or an outside of the housing in package arrangements.

17. The system of claim 1, wherein the housing comprises non-magnetic material and is positioned to rotate about a load bearing part of the rotary component.

18. The system of claim 1, further comprising:

eccentricity correction devices configured to compensate for eccentricity effects coupled with rotation based on measurements received from the plurality of sensors; and a feedback circuit configured to minimize variations in movement and orientation signals based on signals received from the eccentricity correction devices.

19. The system of claim 1, wherein a rotation angle of the housing is actively stabilized at an angle that optimizes magnetic field gradient.

20. A method for ranging in wellbores, the method comprising:

rotating, in a first wellbore, a rotary component having a housing movably attached to the rotating component, wherein the housing rotates with the rotary component relative to the first wellbore;

receiving input to receive a plurality of ranging signals at the rotary component in the first wellbore from the second wellbore;

in response to receiving the input, substantially stopping a rotation of the housing relative to a wall of the wellbore while the rotary component continues to rotate;

generating, in a second wellbore, a magnetic field by passing current through a casing of the second wellbore;

affixing, to the housing, a plurality of sensors with a radial separation to measure a magnetic field gradient used to determine the position of the first wellbore relative to the second wellbore, wherein the plurality of sensors are affixed to outermost edges of the housing to maximize the gradient measurement;

receiving, by the sensors attached to the housing, the plurality of ranging signals at the rotary component in the first wellbore from the second wellbore while the rotary component continues to rotate in the first wellbore, wherein at least a portion of the plurality of ranging signals is received based on the magnetic field generated in the second wellbore, wherein the housing rotates with the rotary component relative to the first wellbore after receiving the plurality of ranging signals at the rotary component in the first wellbore from the second wellbore;

determining a position of the second wellbore relative to the first wellbore based on and in response to receiving the plurality of ranging signals;

measuring a gradient of a magnetic field at a drill string in the first wellbore, the magnetic field originating from the second wellbore, the gradient measured while the drill string is rotating in the first wellbore; and determining a distance between the first wellbore and the second wellbore based on and in response to the measured gradient of the magnetic field.

21. The method of claim 20, further comprising:

receiving input to determine the position of the second wellbore relative to the first wellbore; and in response to receiving the input:

substantially stopping a rotation of the housing relative to a wall of the first wellbore while the rotary component continues to rotate, and receiving the plurality of ranging signals.

22. The method of claim 20, wherein substantially stopping a rotation of the housing relative to the wall of the first wellbore while the rotary component continues to rotate comprises contacting the wall of the first wellbore with at least one contacting device that contacts the wall of the first wellbore.

23. The method of claim 20, further comprising dampening vibration between an outer surface of the housing and an inner surface of the rotary component with a dampening device positioned between the housing and the rotary component.

24. The method of claim 20, wherein substantially stopping rotation of the housing relative to the first wellbore comprises expanding at least a portion of the housing to have a larger outer diameter relative to an outer diameter of the rotary component, the larger outer diameter sufficient to contact at least a portion of the wall of the first wellbore.

25. The method of claim 20, wherein substantially stopping a rotation of the housing relative to the first wellbore while the rotary component continues to rotate comprises affixing a counter-rotation motor to the housing, a speed of rotation of the counter-rotation motor is substantially equal and opposite to a speed of rotation of the rotary component, the speed of rotation maintaining the housing substantially stationary with respect to the rotary component.

26. The method of claim 20, further comprising measuring an intensity and a phase in two or more orientations.

* * * * *